US009974342B1

(12) United States Patent
Kriesel

(10) Patent No.: US 9,974,342 B1
(45) Date of Patent: May 22, 2018

(54) FIREARM RECOILING ABSORBING SYSTEM

(71) Applicant: Matthew Kriesel, Melrose, WI (US)

(72) Inventor: Matthew Kriesel, Melrose, WI (US)

( * ) Notice: Subject to any disclaimer, the term of this patent is extended or adjusted under 35 U.S.C. 154(b) by 12 days.

(21) Appl. No.: 14/999,017

(22) Filed: Mar. 19, 2016

Related U.S. Application Data

(60) Provisional application No. 62/177,895, filed on Mar. 26, 2015.

(51) Int. Cl.
*A41D 13/015* (2006.01)
*A41D 13/05* (2006.01)

(52) U.S. Cl.
CPC ..... *A41D 13/015* (2013.01); *A41D 13/0512* (2013.01); *A41D 13/0562* (2013.01)

(58) Field of Classification Search
CPC ..... A41D 13/015; A41D 13/0562; A41D 13/0512
USPC ..... 2/459
See application file for complete search history.

(56) References Cited

U.S. PATENT DOCUMENTS 960,058 A * 5/1910 West ..... A45F 3/04 2/459
1,587,946 A * 6/1926 Gibson ..... A41D 13/0151 2/16
1,650,491 A * 11/1927 Calvert ..... A41D 13/0012 2/459
2,063,469 A * 12/1936 Smith ..... A41D 13/0151 2/459
2,302,368 A * 11/1942 Evans ..... A41D 13/0151 2/16
2,493,370 A * 1/1950 Smith ..... A41D 13/0151 2/16
2,598,143 A * 5/1952 Smith ..... A41D 13/0151 2/94
2,948,899 A * 8/1960 Allen ..... A41D 13/0151 2/94
2,986,738 A * 6/1961 Zubiate ..... A41D 13/0151 2/268
3,044,075 A * 7/1962 Rawlings ..... A41D 13/015 2/22
3,257,666 A * 6/1966 Hoffman ..... A41D 13/0151 2/267
3,403,407 A * 10/1968 Bishop ..... A41D 13/0151 2/94
4,353,133 A * 10/1982 Williams ..... A41D 13/0151 2/268
4,455,684 A * 6/1984 Johnson ..... A41D 13/0151 2/420
4,493,115 A * 1/1985 Maier ..... A41D 13/0151 2/268
4,507,801 A * 4/1985 Kavanagh ..... A41D 13/015 2/267

(Continued)

*Primary Examiner* — Shaun R Hurley
*Assistant Examiner* — Bao-Thieu L Nguyen
(74) *Attorney, Agent, or Firm* — M. Paul Hendrickson

(57) ABSTRACT

A highly effective firearm recoil absorbing combination is obtained by providing a shoulder mountable assembly containing a viscoelastomeric thermoset polymerizate pad possessing excellent cushioning and rebounding characteristics along with sufficient surface tack to cohesively steady a firing firearm against the pad. The assembly may securely affixed to the shoulder region of a garment or detachably mountable thereto.

20 Claims, 7 Drawing Sheets

(56) References Cited

U.S. PATENT DOCUMENTS 4,642,815 A * 2/1987 Allen ..... A41D 13/0151 2/267
5,014,358 A * 5/1991 Matumori ..... A41D 13/0151 2/85
D340,124 S * 10/1993 Paxton ..... D2/500
5,629,673 A * 5/1997 Juhasz ..... A41D 13/0151 2/94
6,079,055 A * 6/2000 Mencel ..... A41D 13/0512 2/268
6,202,214 B1 * 3/2001 Light ..... A41D 13/0512 2/268
6,485,446 B1 * 11/2002 Brother ..... A41D 13/06 2/455
6,588,023 B1 * 7/2003 Wright ..... F41C 23/08 2/459
6,691,327 B1 * 2/2004 Meyer ..... A41D 13/0512 2/268
7,041,719 B2 * 5/2006 Kriesel ..... A01L 7/02 524/114
D522,214 S * 6/2006 Noell ..... D2/836
7,765,609 B2 * 8/2010 Chase ..... A41D 13/04 2/46
8,099,795 B2 * 1/2012 Stinga ..... A41D 13/0518 2/267
8,302,213 B2 * 11/2012 Kriesel ..... A41D 13/0151 2/102
8,347,421 B2 * 1/2013 Krueger ..... A41D 13/0151 2/459
8,683,614 B2 * 4/2014 Leung ..... A41D 1/205 2/46
8,869,315 B2 * 10/2014 Contant ..... A41D 13/0153 2/267
8,875,319 B2 * 11/2014 Martin ..... A41D 13/015 2/459
9,149,084 B2 * 10/2015 Turner ..... A41H 43/00
9,221,941 B2 * 12/2015 Duggal ..... C08G 18/10
9,332,794 B2 * 5/2016 Mazzarolo ..... A41D 13/018
9,451,795 B2 * 9/2016 Krueger ..... A42B 3/122
2004/0191446 A1 * 9/2004 Kriesel ..... A01L 7/02 428/35.7
2006/0137080 A1 * 6/2006 McCoy ..... A41D 13/0151 2/459
2007/0143908 A1 * 6/2007 Phillips ..... A41D 13/0512 2/459
2008/0081774 A1 * 4/2008 Koch ..... C11D 3/50 510/101
2009/0044319 A1 * 2/2009 Lamson ..... A41D 13/05 2/459
2009/0170974 A1 * 7/2009 De Schrijver ..... C08G 18/10 521/157
2010/0287690 A1 * 11/2010 Kanavage ..... A41D 13/05 2/459
2011/0130477 A1 * 6/2011 Birch ..... C08G 18/36 521/114
2011/0239346 A1 * 10/2011 Doherty ..... A41D 13/0058 2/2.5
2014/0068840 A1 * 3/2014 Nauman ..... A42B 3/128 2/411
2015/0053583 A1 * 2/2015 McCormick ..... A45C 11/00 206/521
2016/0326297 A1 * 11/2016 Burdeniuc ..... C08G 18/24
2017/0202278 A1 * 7/2017 Hazlewood ..... A41D 13/015
2017/0203190 A1 * 7/2017 Turner ..... A63B 71/08

* cited by examiner

FIREARM RECOILING ABSORBING SYSTEM

CROSS-REFERENCE TO RELATED APPLICATION

This application claims the benefit of U.S. Provisional Application No. 62/177,895 filed Mar. 26, 2015, and incorporates by reference herein the provisional application in its entirety.

FIELD OF INVENTION

The present invention relates to shock absorbents and more particularly firearm recoil absorbing combinations, the manufacture thereof and its use to absorb the recoiling effects of firearms.

BACKGROUND OF THE INVENTION

Firearm recoil pads are used by target and other firearm shooters to soften the recoiling effects of firearms. The typical recoiling firearm pad comprises a rubber pad sewn or secured to the shoulder region of the shooter. The pad is designed to absorb the recoiling effects of the firearm. Conventional firearm recoiling pads fail to effectively absorb firearm recoiling forces and particularly lack the rebounding and recoiling capacity to stabilize repetitive recoil firing sequences. Moreover, the most commonly used pads are typically made from synthetic or natural rubbers which cannot provide effective shock absorbtion or maintain aiming stabilization and especially under conditions of rapid fire. The conventional rubber based pads are also bulky, cumbersome, motion inhibitive and uncomfortable to the shooter. Although these bulky shoulder pads arrest recoil to a certain degree, the unnatural feel and lack of surface tack tends to further hinder the shooter's ability to maintain a steady and accurate aim especially upon repetitive firing of the firearm. The firearm bouncing and recoiling effect is also uncomfortable and hurtful to the shooter.

There exists a need for a better firearm recoiling system pad which more effectively absorbs the recoiling effects of a firearm while also stabilizing and facilitating the shooter's shoulder positioning and aiming of the firearm during each ensuing shot.

SUMMARY OF THE INVENTION

The present invention provides a superior firearm shoulder recoil absorbing assembly and its combination with a firearm shooting garment to effectively absorb firearm recoil while also maintaining the shooting firearm in a steadied position for effectively aiming successive target shots. This allows the shooter to maintain a steadfast placement of firearm butt end firmly against the shoulder mounted recoil absorbing assembly which greatly improves upon targeting accuracy. The recoil arresting assembly also includes a highly effective shock or recoil absorbing pad exhibiting exceptional efficacy in absorbing recoil created by a recoiling firearm. The assembly utilizes a unique pad formulated with a thermoset viscoelastomeric polymeric material which exhibits an unusually high order of firearm recoiling absorbency and unique rebounding characteristics. The unique pads exhibit surprising shock absorbent properties even when provided at a pad size measuring less than 2 mm in thickness. The recoil arresting pads herein also possess a high degree of flexibility rendering them an excellent match to complements the movement and flexibility of the garment to which they are attached. The thermoset viscoelastomeric pads used herein also possess a sufficient degree of tackiness to prevent the recoiling firearm from bouncing off its shoulder aiming mount. This significantly reduces recoil shoulder irritation and greatly assists the shooter in maintaining shoulder contact and accurate aiming especially after repetitive firing recoiling events. In order to maximize the multiple functionality of the recoil arresting assembly, the thermoset impact absorbing polymeric material may be appropriately placed upon a garment so as to be in direct contact with the butt end of the firing firearm.

DETAILED DESCRIPTION OF THE INVENTION

Figure 1:
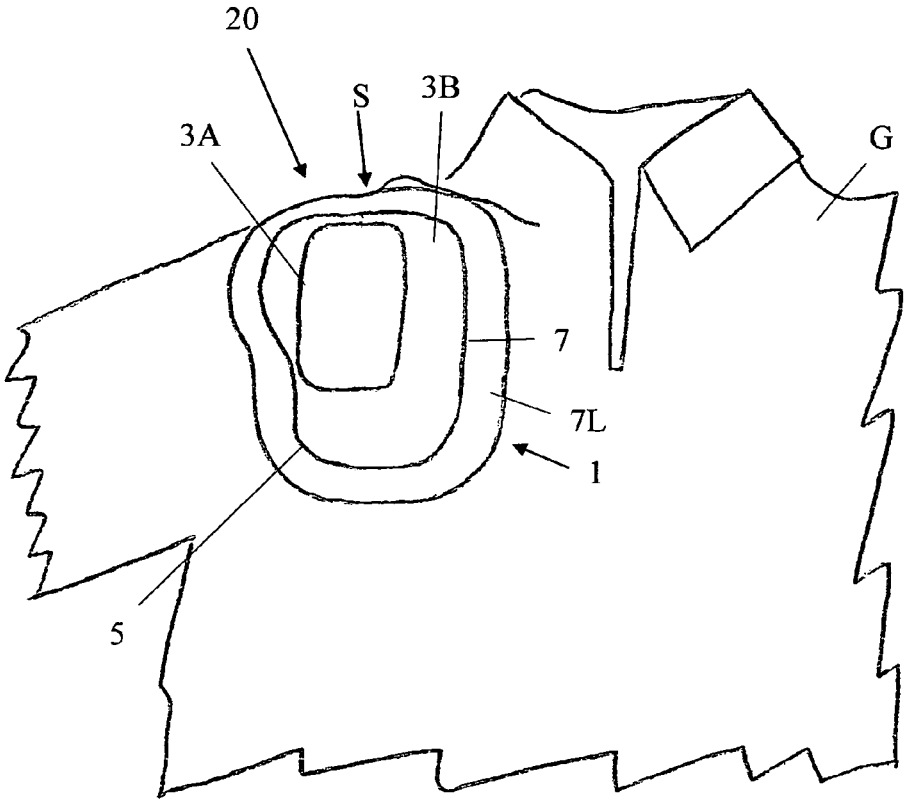
FIG. 1 depicts a frontal view of a garment mounted firearm recoil arresting combination of this invention.

FIGS. 1-8 reveal unique embodiments of a firearm recoil absorbing combination 20 and a mountable assembly 1 which embodies different mounting means for mounting the assembly 1 upon a garment G at a firearm aiming site S. The firearm recoil arresting combination 20 generally comprises:

A) a firearm recoil arresting assembly 1 comprised of:

a.) a recoil absorbing pad 3 of a thermoset viscoelastomeric polymerizate positioned for interfacial contact onto a butt end of a firearm with said pad 3 possessing sufficient viscoelastomeric characteristics to absorb recoiling forces created by a firing firearm while also providing sufficient surface tack to create a cohesive adherence to the butt end of a firing firearm;

b.) a flexible pad retaining member 5 serving to securely retain the pad 3 at the mounting site S;

c.) attaching means 7 for attaching the assembly 1 to the mounting site S; and d.) an upper garment G having the assembly 1 mounted at the firearm aiming site S.

The firearm recoil absorbing combination 20 of this invention provides unexpectedly superior benefits over conventional firearm recoil absorbing systems. The firearm recoil arresting combination 20 unexpectedly provides superior firearm recoil absorbtion and cushioning. The combination 20 creates a highly comfortable hunting gear accessory without adversely affecting the shooter's dexterity and the proficient aiming of the firearm. Compositionally the recoil absorbing pad 3 includes a unique recoil absorbing thermoset elastomeric polymer especially adapted for arresting firearm recoiling forces and providing direct interfacial cohesive contact with the butt end of the firearm. Surprisingly the flexible viscoelastomeric pad 3 exhibits unexpectedly superior recoil absorbency properties even when the pad 3 is provided in a relatively thin pad form (e.g. 2 mm or less). Although the firearm recoil absorbing combination 20 is suitable for target shooting purposes, it may also be utilized for a host of other shooting uses (e.g. game hunting, police, military and other typical firearm uses), all of which benefit from its exceptional recoil absorbent and rebounding attributes.

The combination 20 fitted with the assembly 1 provides several unique attributes which significantly enhances its efficacy as a firearm shock or recoil absorbing combination 20. Unlike conventional firearm recoil arresting pads which exhibit volumetric changes upon compression and decompression exposure, the viscoelastomeric pads 3 herein function in a manner similar to fluids under pressure. An externally pressure applied to the viscoelastomeric pad 3 causes a deformation or distortion of the viscoelastomeric pad mass, but essentially no volume change in the pad 3. However unlike free fluids, the viscoelastomeric pad 3 slowly rebounds to its indigenous form upon the pressure release therefrom. The displacement and rebounding characteristics of the pad 3 provides exceptional viscoelastomeric firearm recoil arresting efficacy including a cushioning shock absorption while also providing exceptional rebounding characteristics in a controllable release of the recoiling effects even under the most stringent firearm shooting conditions. Due to the exceptional recoil absorbtion efficacy of pad 3, the firearm shooter is effectively shielded and dampened from the firearm recoiling impacts which sensually results only in a nominal feeling of the recoiling and rebounding effects. Shoulder soreness and firearm shooters fatigue are significantly reduced by the firearm shock absorbing assembly 1 herein. Since the pad 3 is compositionally formulated to provide a cohesive surface, interfacial surface bouncing of the firearm upon pad 3 is substantially diminished. These cohesive attributes in combination with the viscoelastomeric attributes significantly contribute towards stabilization of marksmanship positioning and aiming especially under rapid or repetitive firearm shooting. Since the pad 3 possesses excellent flexibility due largely to its viscoelastomeric properties, the assembly 1 and its mounted combination 20 preserve shouldering flexibility so as to maintain the optimum dexterity required for effective marksmanship. Unlike the most commonly used synthetic and natural rubber firearm shock absorbing pads which customarily possess insulative properties creating hot spots and discomfort, the pads 3 herein uniquely provide heat or thermal conductance to alleviate hot spot development. This provides a more uniform thermal distribution of localized heat throughout the shooter's shoulder mounting and aiming position.

The efficacy of the firearm recoil arresting combination 20 herein is significantly enhanced by the viscoelastomeric pad 3 having a direct interfacial contact with the shouldering butt end of the recoiling firearm. The cohesive interfacing relationship provided by pad 3 steadies and maintains the firearm cohesively against the shoulder mounting site S at the aiming position which is especially beneficial under shooting conditions involving rapid firing and recoiling sequences such as often arises during military, hunting, target practice, clay or skeet targeting, etc. actions. Because the viscoelastomeric pad 3 creates a mild fluidized cushioning feeling under recoiling impact, the firearm recoiling effects are dramatically dampened.

Figure 2:
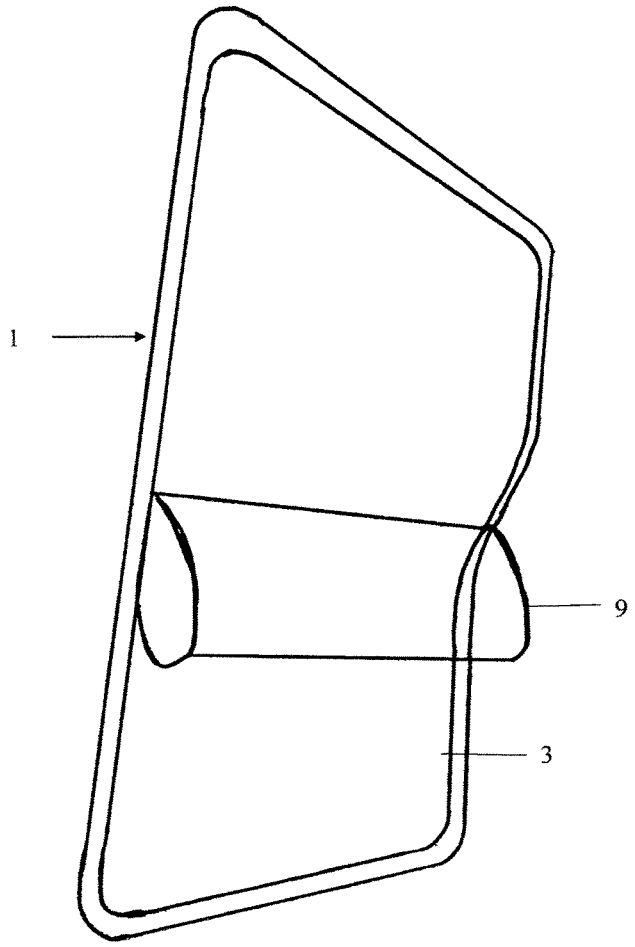
FIG. 2 depicts a top view of the recoil absorbing pad shown in FIG. 1 equipped with a protective cover to protect the shock absorbing pad against external contamination.

FIGS. 1-2 and 4-8 illustrate firearm shock absorbing assemblies and alternative mounting means 7 for mounting the assembly 1 to garment mounting site S to provide a field ready firearm recoil arresting combination 20. The Figures depict variations in the mounting means for attaching or securing the assembly 1 to a garment G at a shoulder mounting and aiming site S. The firearm recoil absorbing assembly 1 herein may accordingly incorporated a number of supportive pad backings 5 which support pad 3 in a mountable form and involve the utilization of a highly effective firearm recoil absorbing pad 3 anchored or secured to a desired fixed shoulder mount position S for aiming the firearm. Since the pad 3 possesses a cohesive attraction to many of the synthetic textiles (e.g. nylon, polyesters, rayons, etc.) the garment G itself may be cohesively compatible and provide the suitable flexible pad retaining member 5 for mounting the pad 3 to the shoulder aiming mount site S. The direct mounting may include the cohesive attachment of a pad 3 such as shown in FIG. 2 directly to the garment mounting site S.

Figure 5:
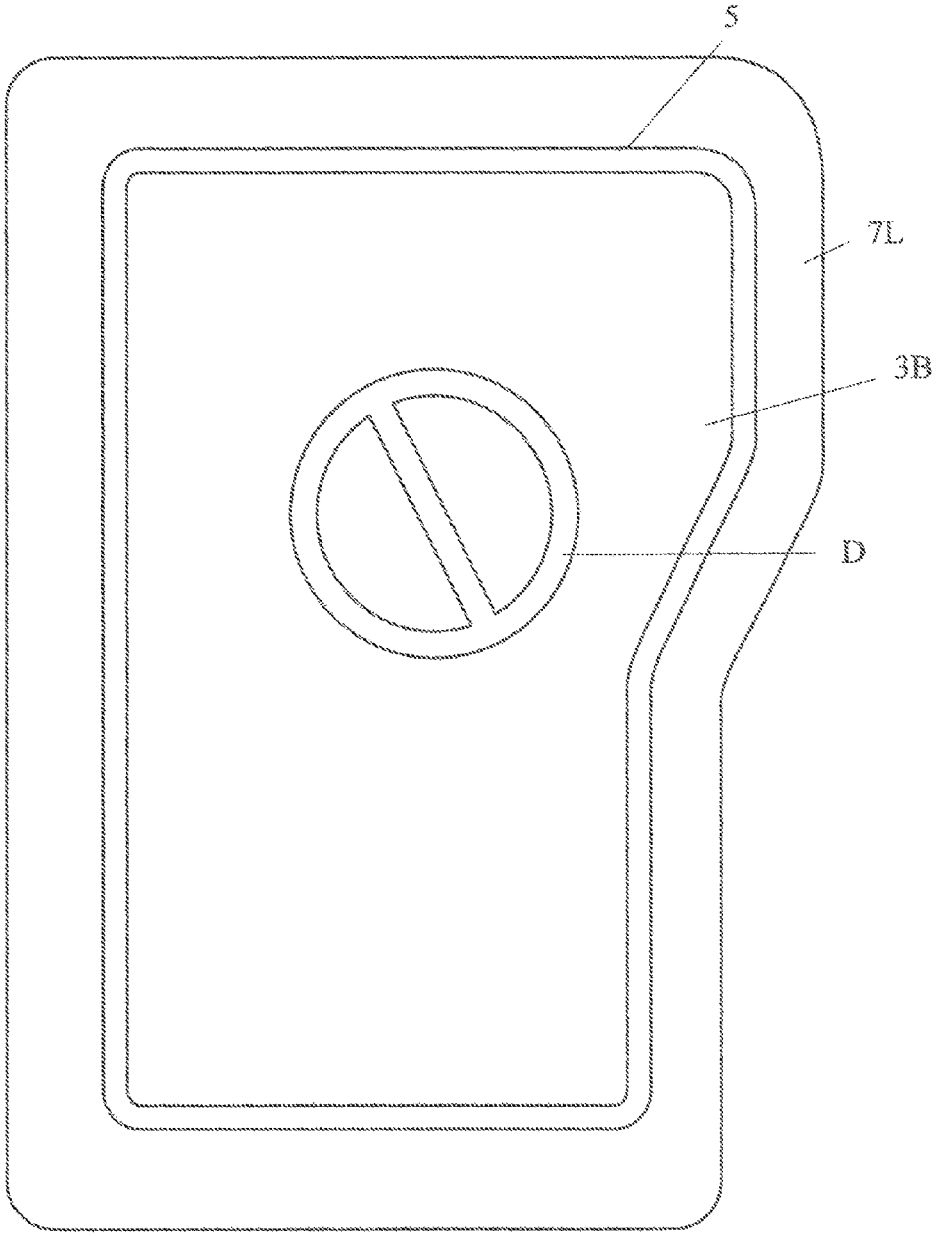
FIG. 5 depicts a rear view of the firearm recoil absorbing assembly of FIG. 1 showing the shock absorbing pad and a bordering flexible support member adapted to be sewn to a shoulder shooting site of the garment.

The impact absorbing pad 3 and assembly 1 as depicted by FIGS. 1 and 5 may be formed by a molding of the thermoset pad 3 within a molded thermoplastic support member 5 which serves as a mold to retain the uncured recoil impact absorbing pad reactants until cured. The mountable assembly 1 depicted by FIGS. 1 and 5 thus entails using a flexible pad support 5 for molding pad 3 and then mounting the assembly 1 comprised of the molded shock absorbing pad 3 and flexible pad support 5 at a desired shoulder mounting position or site S to provide the firearm shock absorbing combination of FIG. 1. These objectives may be effectively accomplished by using a pliable and moldable plastic film material which initially serves to house or retain the uncured pad reactants during the molding and thermoset curing of pad 3. The flexible pad support 5 with the molded pad 3 therein provides an appropriate pad support for positioning and securing pad 3 to the desired garment shoulder anchoring site S.

Figure 3:
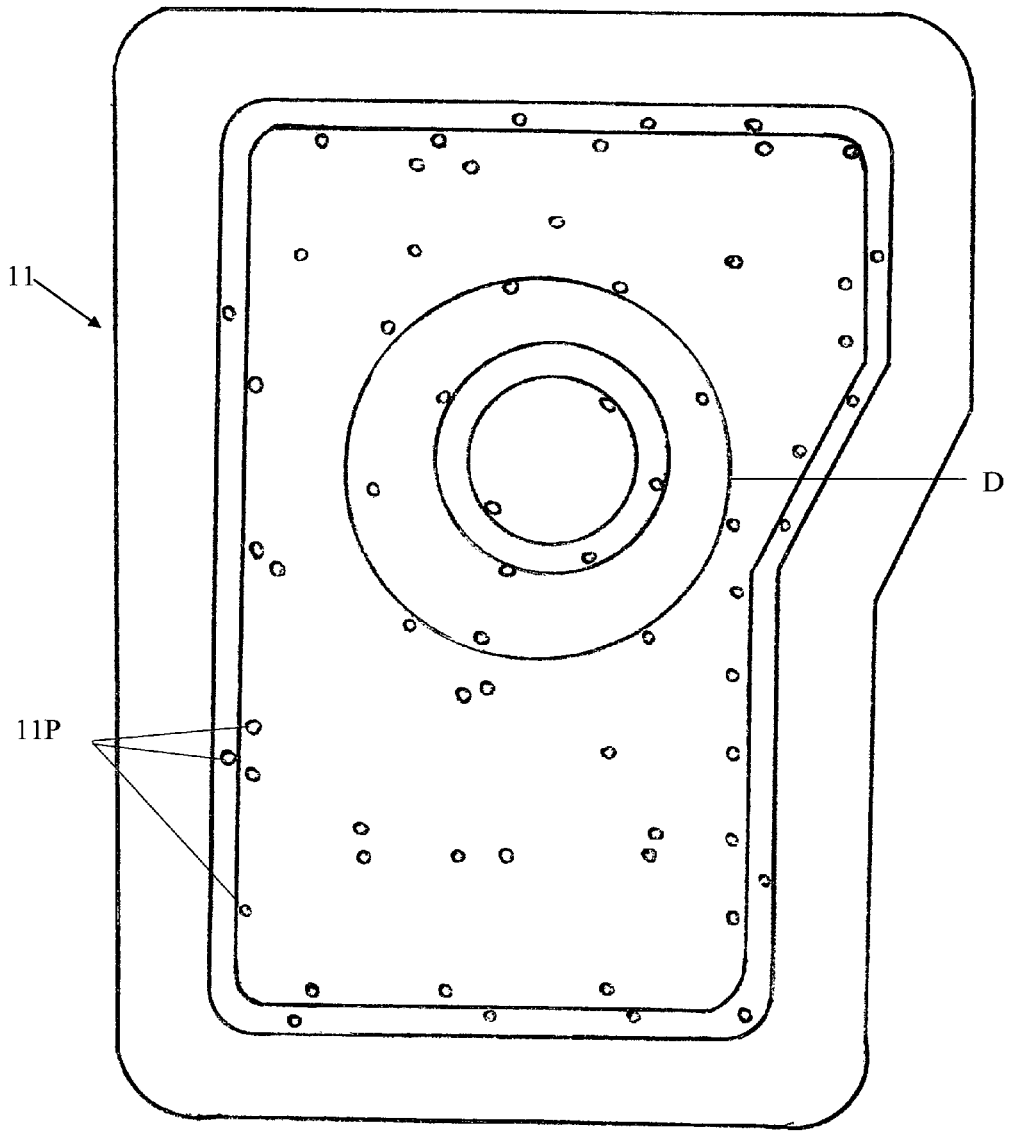
FIG. 3 is a top view of a forming mold which may be used to prepare the garment mountable recoil arresting assembly shown in FIG. 1.
Figure 4:
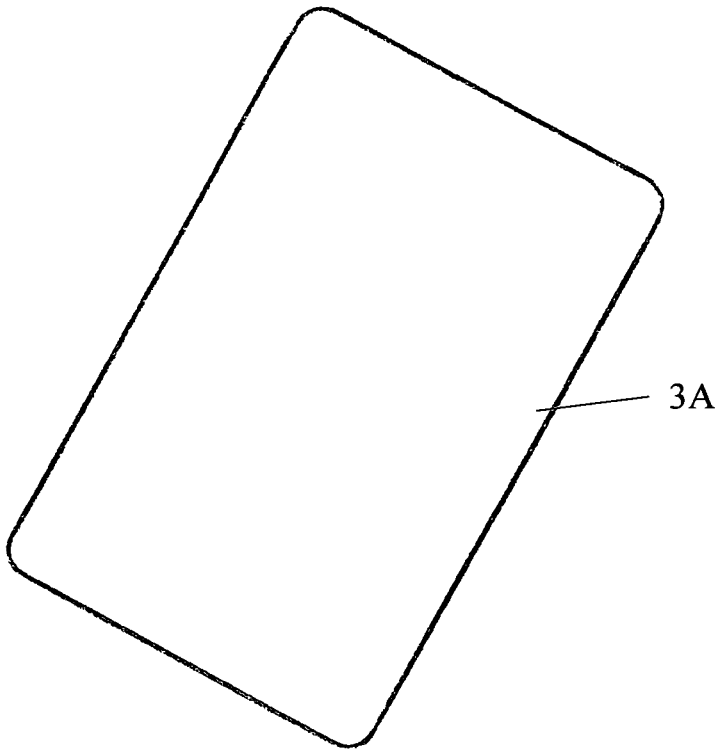
FIG. 4 depicts a frontal view of an outwardly positioned recoil absorbing pad shown in FIG. 1.

FIG. 3 illustrates a suitable mold 11 for manufacturing the pad 3 depicted by FIGS. 1 and 5 using a flexible plastic film as a forming mold to cure the uncured thermosetting reactants of the pad 3 and thereafter relying upon the flexible pad support 5 for housing and mounting pad 3 to the garment G. As depicted by FIG. 3, an appropriate vacuuming mold 11 may be used to provide a vacuumed formed pliable retaining member 5 sized to retain pad 3 which in combination with pad 3 imparts exceptional flexibility and comfort about the shoulder mounting site S.

Using the vacuumed forming mold 11 under thermal molding and heat setting conditions, a moldable flexible thermoplastic film may be initially vacuum formed under heat molding conditions into a desired molding shape for the subsequent depositing, retaining and curing of the appropriate thermosetting viscoelastomeric reactants to create the desired thermoset recoil arresting pad 3. The mold 11 depicted by FIG. 3 may be conformed for any shape, coloring and design, etc. which may be desired in the recoil absorbing pad 3. As may be further observed from FIG. 3, the forming mold 11 includes a plurality of vacuuming ports 11P sufficient in number and spacing to vacuum the moldable flexible thermoplastic film onto the recessed impressions of mold 11. Through proper sizing of the flexible plastic film support 5 which necessarily has a melting point higher than that of the curing thermoset reaction temperature (e.g. typically greater than 100° F.), the flexible pad support 5 member suitably serves to cure the uncured thermosetting pad reactants while also becoming an integral part of the garment mounted combination 20.

The flexible thermoset or thermoplastic support member 5 in combination with the pliable characteristics of the viscoelastomeric polymerizate pad 3 provides a firearm recoil arresting assembly 1 which fully complements the desired innate flexibility of the garment G. The flexible pad retaining member 5 when provided as a pad support or housing may be of a relatively thin film form as depicted by FIGS. 1 and 5. The flexible thermoplastic vacuum molding procedure includes the introduction of external heat to allow for the thermal shaping of the thermoplastic film and a subsequent cooling to set the thermoplastic film in its molded form. The compositional make-up of the pad 3 coupled with the flexible pad retaining or support member 5 creates a highly effective assembly 1 which is fully compatible with the flexibility attributes of the shooter's garment G. The flexibility of assembly 1 correspondly matches the garment flexibility which in turn allows for full freedom of firearm movement by the shooter about its shoulder mount S and aiming position. Typically a moldable film stock (e.g. 2 to 8 mil film) will appropriately provide a suitable pad curing mold 11 and a flexible pad support 5 for retaining pad 3 to assembly 1. As a general rule, film flexibility typically decreases as film thickness increases. Although not essential, a clear and transparent film may be used as flexible pad retaining member 5 so as to visually reveal the underlying camouflaged fabric or coloring when mounted to the garment G.

In the manufacture of assembly 1 depicted by FIG. 5, the flexible support member 5 when used as a mold may comprise any commercially available shrink wrap thermoplastic cohesively compatible with pad 3 and tailored to the desired size and configuration for its intended end use. A shrink wrap film commonly referred to as TPU (thermoplastic polyurethane) characteristically meets the moldable, melting point and cohesive pad compatibility criteria to be used as a retaining film 5. The TPU film when used may be placed in an overlying vacuum sealing relationship with mold 11. In the presence of a suitable heat source and vacuum to draw the TPU film into the mold 11 and thereafter cooling the desired molded shape for the flexible support 5 and pad 3 of assembly 1 may be provided.

As illustrated by FIG. 1, the assembly 1 may also include multiple shock absorbent pads 3A &3B which dual mounting system allows the outer shock absorbing pad 3A to be conveniently removed from the assembly 1 while also serving to effectively cohesively engage the firearm at a steadfast aiming position. In the combination 20 depicted by FIG. 1, the inner pad 3A is fully encased by the flexible molded thermoplastic film (e.g. TPU) which serves as flexible pad retaining member support 5 for both pads 3A & 3B.

Since cohesiveness normally bears a direct correlation to the contracting surface area, the cohesive attraction of pad 3A as depicted by FIG. 1 will have a greater cohesiveness at its cohesive attachment to the flexible pad retaining member 5 than the cohesive interfacing forces at the butt end of the firearm. Consequently an outwardly pulling force will selectively release the butt end of the firearm before meeting the force threshold for the release of pad 3A. Thus in the attachable and detachable pad 3A embodiments herein, the interfacial cohesive characteristics of the pad 3 interfacing firearm butt end and that facing its shoulder mount S or securement to a flexible support 5 will create a higher degree of surface tackiness within the shoulder mounting region or flexible support member 5 than at the firearm butt end. By substantially reducing or increasing the total pad 3 contacting surface area, the cohesive characteristics of the pad surface may be altered. By decreasing or increasing the total interfacing surface area, the degree of tack and adhesion of the pad 3 may be accordingly decreased or controlled so as to provide a selective release and cohesion.

Any flexible backing or material which cohesively engage onto the viscoelastomeric pads (including fabrics and garments) may be used as the flexible pad retaining member 5 herein. A host of heat moldable thermoplastic films other than TPU may accordingly be used as a flexible pad retaining member 5 herein. The flexible thermoplastic film 5 should cohesively engage onto pad 3. Certain films such as the polyvinylchlorides (PVC) and silicon based films generally lack a cohesive adherence to pad 3 and therefore are generally unsuited. Other illustrative thermoplastic films exhibiting a cohesive affinity to pad 3 include the flexible polyolefins such as the polyethylenes, polypropylenes (e.g. HDPE, HDPP). The thermoplastic films may be relatively thin (e.g. less than 1 mil) provided the film possess sufficient structural strength for its supportive use. Conversely excessively thick films which fail to contribute the desired flexibility and possess processing difficulties in the manufacture of assembly 1 are generally undesirable. Although the thermoplastic films for use as the flexible pad retaining member 5 herein may broadly range from about 1 mil to about 30 mils a most practical operational range typically ranges from about a 2 mil to about 5 mil thermoplastic film thickness.

The flexible pad support 5 may be provided with an appropriate mounting means such as with suitable fastening members 7 for the mounting assembly 1 to the shoulder mounting site S. As illustrated by FIGS. 1 and 5, the pad assembly 1 may include a peripheral flexible plastic film mounting lip or flange 7L which allows the retained shock absorbing pad 3 to be directly sewn to the garment G to provide the firearm recoil absorbing combination 20. If desired, the recoil absorbing pad 3 or pads may be seated or otherwise affixed within the flexible mold 11 so as to position pad 3B at an exposed open-faced relationship which would permit for pad 3B removal for stowage, maintenance, replacement, etc. The pad retaining mold 11 equipped with a peripheral overhanging attaching lip 7L as illustrated by FIGS. 1 and 5 provides a bordering margin which allows the flexible pad retaining support 5 with the cured inlaid thermoset polymeric pad 3 to be directly sewn onto a shirt shoulder mounting site S. If desired, pad 3 and lip 7L may be appropriately covered with a fabric (e.g. camouflaged) to match that of the garment G to which it is sewn onto. However, a clear transparent pad retaining film 5 and bordering attaching lip 7L of assembly 1 (such as the transparent protective covering shown in FIG. 2) generally provides sufficient transparency so as to visibly reveal the coloring or design (e.g. camouflage, etc.) of the underlying garment. The positioning flanged lip 7L of the pad support member 5 may be adjusted so as to permit an exposed orientation of the outermost exposed tacky pad surface of assembly 1. As depicted by FIGS. 1 and 5, pad 3 may be completely covered with a covering such as a plastic film or partially open faced coverage which may expose both the upper or lower surface area of pad 3 for cohesive contact.

The combination 20 shown by FIGS. 1 and 5 depicts a film encasement of the innermost pad 3B with a plastic film. The encased flexible pad support 5 shields the pad surface of pad 3B from direct cohesive exposure to the gun butt. To take advantage of the pad cohesive properties in stabilizing the shooter's firearm mount to the shooter's shoulder aiming site S, an outer pad 3A is appropriately included in the two pad assembly 1 and combination 20 as shown in FIG. 1. If desired, the vacuum molded flexible pad support member 5 therein may include whatever design D or functional attributes as may be desired to be imparted to the cured pad 3 (e.g. see FIGS. 3 and 5) including any surface area valleys and ridges to provide selective adherence or preferential release of a the firearm from the outer pad surface. Logos identifying the commercial product source, vendors, coloring, etc. or other desired impressions or markings may also be incorporated into the mold 11 for impression upon the formed flexible retaining member 5 or the pad 3.

The assembly 1 may be provided in a form wherein the pad 3 as housed within the molded flexible pad support member 5 provides a seat for an open-faced positioning of a single assembly pad 5 which may be sewn to the garment G via an affixing flanged lip 7L positioned in alignment with the innermost surface of pad 3B. Under this manufacture, the open-faced flexible support member 5 may be separately formed or molded within the mold 11 followed by the subsequent injection of the uncured reactants for curing pad 3 within the flexible support member 5. Thus, the molded flexible support member 5 may be used as a recessed housing having a margining lip 7L about the cornering sidewall edge for sewing the open-faced flexible support 5 housing the open-faced pad 3 to the garment G. This arrangement eliminates the need of dual pads 3. In this latter embodiment the open-faced molded flexible support 5 is also open or exposed to permit the placement or removal of pad 3 therefrom with a protective covering 9 most suitably serving to protect against contamination when the pad 3 is not in use.

The cured thermoset reaction product of pads 3 imparts a high degree of surface tack to the cured pad 3. The cohesiveness of pad 3 in an open-faced pad mount is generally sufficient so as to cohesively retain pad 3 to its flexible pad retaining member 5. If desired the surface tack cohesiveness may be lessened by reducing the overall contact surface area of the contacting pad 5 which may involve creating a molded surface having ridges or valleys to reduce the total contacting surface area. When pad 3A is mounted in the molded flexible pad retaining member 5 as illustrated by FIG. 1, the total pad surface interfacing onto the pad retaining member 5 creates a substantially greater cohesive surface attraction than that of the firearm butt end.

The recoil arresting pad 3 when compositionally properly formulated imparts a substantial degree of surface cohesiveness which allows the pad 3 to cohesively stick to other contacting surfaces but also to be cohesively detachable therefrom. The degree of surface cohesiveness for a cohesively compatible object bears correlation to the total interfacial contact area which exists between the pad 3 and the contacting object. Thus, a flat surfaced pad 3 contacting onto a flat surfaced object will typically exert a substantially higher degree of cohesiveness in contrast to a ridged surfaced pad. Similarly a pad 3 having the total contacting surface area as provided by molded flexible support member 5 as depicted by FIGS. 1 and 5 will possess a substantially greater contacting surface area and cohesive attraction than the butt end of the firearm. Thus, a substantial higher degree of force would accordingly be required to remove pad 3 from its molded flexible support member 5 of FIGS. 1 and 5 than that force needed to remove the firearm butt end from pad 3. These principles apply in retaining the pad 3 onto its flexible pad retaining member 5 and its securement to the garment mounting site S.

Compositionally the tacky surfaced pads 3 are prone to pick-up lint, dust particles, etc. which can severely diminish the tack efficacy of pad 3. Without undertaking the necessary precautions to prevent clogging and contamination of the recoiling absorbing pad 3 surface, the pads 3 will lose the desired tack. This becomes a particular acute problem within the environment in which firearms are customarily used. Surface contamination creates a clogging barrier which substantially lessens surface tack and cohesiveness of pad 3. Washing with conventional solvents or detergents can restore the desired surface tack. However under its normal usage, the washing of the pad 3 during its field use is impractical. In order to preserve the tackiness of a removable pad 3, a contaminate barrier member 9 (e.g. flexible plastic film member or other suitable removable or detachable covering) as illustrated by FIG. 2 serves as a pad contamination protector. This protective barrier 9 maintains the pad interface substantially free from contaminating and clogging dust, lint particles, etc. which in turn allows repetitive and extended use of the firearm recoil absorbing pad 3 in a combination 20 having an outwardly exposed surface subject to external contamination. The protective cover 9 may be incorporated or designed into the assembly 1 or simply applied as a separable protective cover 9 as illustrated by FIG. 2. A protective covering 9 will accordingly provide a desired lint free surface to preserve pad 3 tack in a field ready-to-use form. Accordingly, the targeting shooter may apply the protective covering 9 when the assembly 1 or combination 20 is not in use and then subsequently remove it when needed for shooting exercises.

Figure 6:
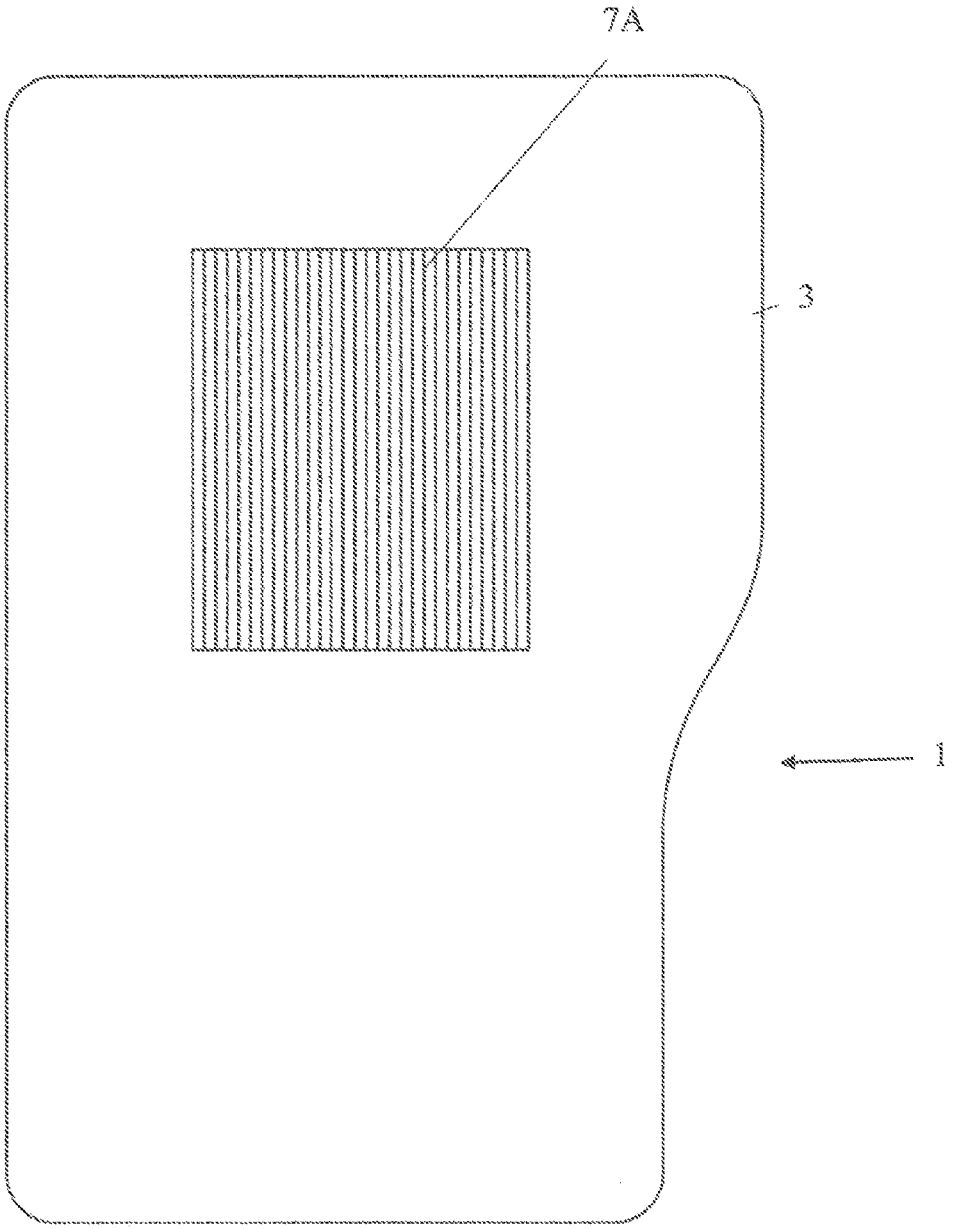
FIG. 6 depicts a rear view of an alternative fastening member of a paired fastening system attached to the recoil absorbing pad shown in FIG. 1.
Figure 8:
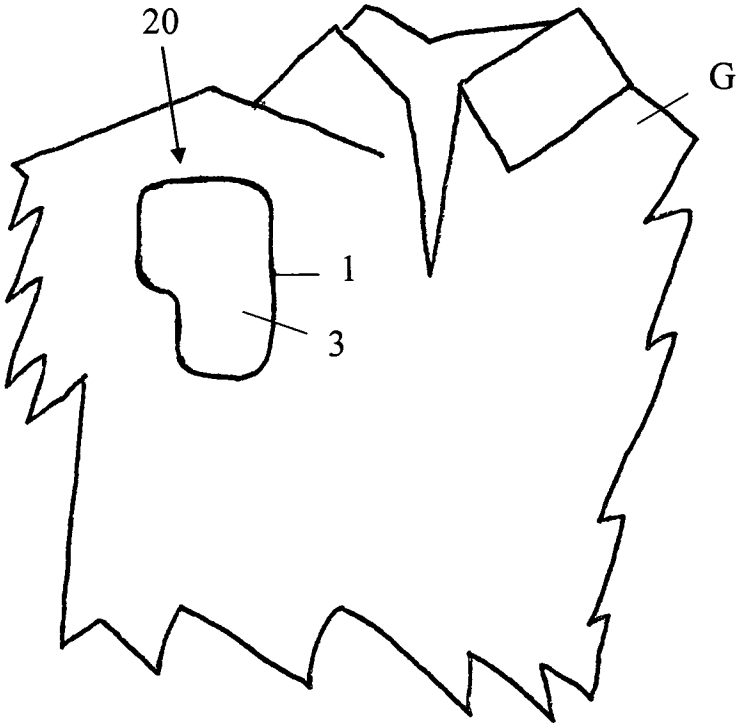
FIG. 8 is a frontal view of a combination of this invention depicting a garment section having the firearm recoil arresting combination mounted to a shoulder mounting position with the fastening system of FIGS. 6 and 7.
Figure 7:
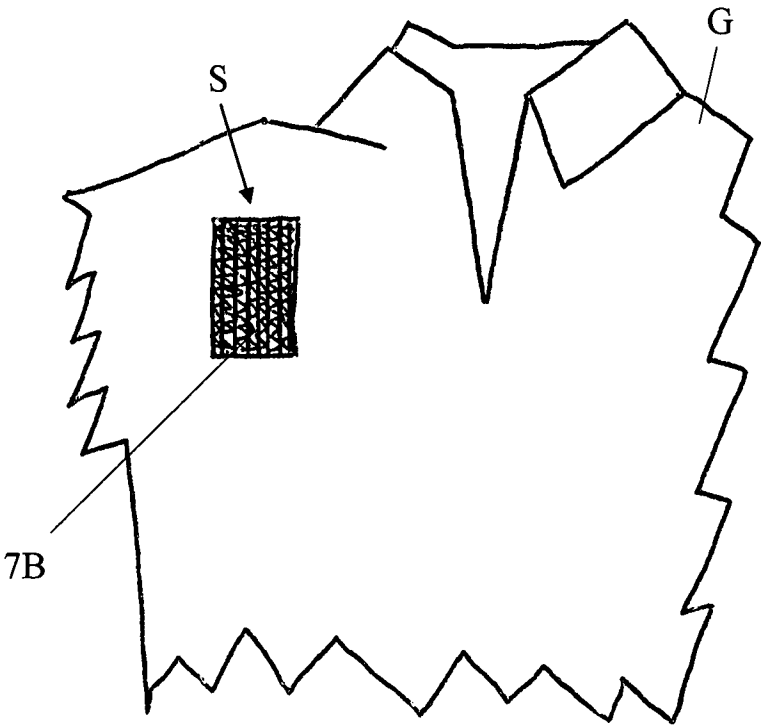
FIG. 7 depicts a frontal view of a shirt garment section having a shoulder region fitted with a mating fastener member to the fastening system shown in FIG. 6.

Irrespective of the particular mode of placing the recoil absorbing assembly 1 at an appropriate shoulder shock absorbing site S, the mounting means 7 should securely mount the assembly 1 so as to prevent any substantial movement or straying from its original mounted position. The assembly 1 of this invention is accordingly adapted to maintain its original mounting site S while also inhibiting recoiling bounce of a firing firearm via its cohesive surface tack and exceptionally effective viscoelastomeric properties. Thus, whatever form the firearm recoil absorbing assembly 1 may be provided for its attachment to the garment G, the assembly 1 will effectively embody securing means which firmly secures pad 3 to the shooter's garment G at a suitable firearm aiming site S. Secure anchoring may be effectuated by any mounting means 7 which securely affixes the assembly 1 at the desired garment shoulder mount site S. Secure mounting of the assembly 1 as illustrated by FIGS. 1 and 5 to the garment shoulder mounting site S may be effectively accomplished by securely sewing the assembly 1 or alternatively through the use of other fixed mounting means including essentially permanent mounts (e.g. permanent adhesive boding as well as two sided adhesions, etc.) or attachable and detachable mounts or systems such as the mating fastener 7A & 7B as depicted by FIGS. 6-8. An appropriate textured garment cohesively compatible and mountable onto pad 3 may also serve as a means of retaining and affixing the cohesive pad 3 to provide the firearm recoil arresting combination 20.

The recoil absorbing pad assembly 1 may be accordingly provided in a form which allows for attachment and detachment of the pad assembly 1 from its garment shoulder mount S without adversely affecting the wearer's comfort. The mounting means 7 for mounting the pad assembly 1 to the garment G will typically retain garment flexibility and comfort so as to preserve an uninhibited freedom of motion. This necessitates the use of fasteners 7 which do not substantially detract from the freedom of motion about the mounting site S as customarily afforded by the garment G. Compositionally and physically pad 3 will readily conform to underlying objects due to its unique flexibility and viscoelastomeric properties. Thus, the recoil absorbing pad assembly 1 will readily compensate for any underlying projections or pressure points which would normally be a source of irritation or movement restrictions. The pad 3 adhesive attributes may provide an integrated compatibility and attachment to the garment G so as to emulate a feeling as if the combination 20 were an intrinsic part of the garment G. The pad cohesiveness also allows for its direct securement to a cohesively compatible garment G by using a pad 3 such as shown in FIG. 2. Although a clean pad surface may be directly mounted to traditional garment fabrics relying upon the garment G as the flexible pad support 5 subsequent reuse of the pad 3 upon garment tends to contaminate pad 3 with fibrous materials and other debris so as to render it ineffective for cohesive secureness onto the garment mounting site S. Thus the assembly 1 which provides a flexible pad retaining member 5 for attachment to the garment G will more effectively preserve the efficacy of pad 3.

Besides being sewn to the garment G as illustrated by FIG. 1, the pad assembly 1 may be equipped with a wide variety of fastening means 7 including attachable and detachable means for attaching the assembly 1 to an appropriate firearm aiming or mounting site S. These attaching and detaching fastening members 7 may be provided as paired fastening members 7A & 7B as illustrated by FIGS. 6-8 which when matingly fastened together secure the assembly 1 to its desired garment shoulder mounting site S. For example, the garment G and pad assembly 1 may be provided with mating attachable and detachable members 7A & 7B such as snap fasteners, zipper fasteners, VELCRO type fasteners, eyelet and toggle type fasteners, laced fastener systems, etc. For attachable and detachable system, one of the mating fastening members (e.g. 7A or 7B) will typically be mounted or fastened to the assembly 1 while the other mating fastening member (7A or 7B) will be typically secured to the shooter's shoulder garment mounting site S. A comfortable attachable and detachable combination 20 is thereby provided since the pad 3 compressively cushions and conforms to the shape of the fastening members 7A & 7B which alleviates any discomfort attendant to the underlying fastening members 7A & 7B.

FIG. 6 depicts a rear view of an attachable and detachable recoil absorbing firearm assembly 1 of this invention. In order to realize the full benefit of the combination 20 the outermost sticky pad surface should directly abut onto a firearm butt end so as to dampen the recoiling and rebounding effects which significantly facilitates the maintenance of a proper shoulder firearm aiming positioning especially under repetitive firing sequences. As further depicted in FIGS. 6-7, the flexible pad support system 5 may actually constitute an integral part of one of the paired fasteners used to fasten or secure the assembly 1 to the garment mounting site S. Conventional fasteners of the VELCRO type customarily include a flexible base upon which the fastening members are mounted. The female fastener 7B typically comprises a flexible plastic base supportive of a napped surface having loops or hooks which serve to hook onto the male fastener hook engaging features 7A which is similarly supported by a flexible plastic base. The flexible fastener combination 7A & 7B may entail cohesively fastening one of the fasteners 7 to the pad 3 and the other to the appropriate garment mounting site S. The flexible fasteners 7A & 7B may accordingly serve the dual purpose of providing both an auxiliary flexible support member 5 and a fastening system for fastening the assembly 1 to the garment mounting site S. Other paired fastener combinations similarly relying upon flexibility attributes for fastening the assembly 1 to the garment G may illustratively include zippers, hooks and eyelet fasteners, buttoned buttons, and other fastener combinations etc. The interfacing surface placement of the pad 3 onto the shouldering shirt or garment G region should also be designed so as to firmly anchor and prevent pad assembly 1 and firearm slippage.

The pad 3 should also physically and compositionally impart an exceptional level of firearm recoil arresting efficacy. This efficacy is uniquely reflected by the relatively thin pad thickness actually needed to effectively arrest the recoiling effects of a firing firearm. The pads 3 as used in assembly 1 exhibit more than a two-fold greater recoil absorbing efficacy over conventional rubber shock absorbing pads. This results in an ability to significantly reduce pad thickness to achieve a higher degree of shock absorbing efficacy. Although the pads 3 used herein are more flexible and pliable than conventional pads, the ability to use pads 3 of a smaller pad thickness further enhances the pliability of pad 3 and its mount and especially under recoiling conditions. Consequently a dimensionally smaller pad may be effectively used herein to create and unexpectedly superior efficacy in arresting the recoil of a firing firearm. Pads 3 of a thickness ranging from about 1 mm to about 10 mm and most usually between about 3 mm to about 8 mm have been found sufficient to produce exceptional shock absorbency efficacy over conventional rubber firearm shock absorbing pads 3. Thicker pads 3 (e.g. ¼-½ inch) or thicker may be used without seriously detracting from a desirable degree of garment flexibility but are unnecessary due to exceptional recoil arresting efficacy of pads 3.

The exceptional pad 3 efficacy may be effectively accomplished by chemically formulating the thermoset polymerizate conditions so that pad 3 possesses the appropriate level of tack or adhesiveness while also providing the essential recoil absorbing attributes. Although a broad range of thermoset or thermoplastic polymers meeting the desired shock absorbing, rebound, compression and the surface tack characteristics of pad 3 may have potential use herein, certain thermoset urethane polymerizates relying upon an epoxidized vegetable oil as predominate reaction media ingredient have been found to be especially effective for use as pads 3 herein. These recoil pads 3 may be appropriately prepared using thermosetting polymerizable precursor reactants to provide a carbamate linkage for the desired thermoset polyurethane polymerizate possessing the desired tack and recoil pad attributes. Thermoset polymerizates useful herein may be provided in a viscoelastomeric form possessing a sticky surface for cohesively maintaining a firearm in a steadfast shooting position while also providing the desired firearm recoil cushioning and rebounding properties. Particularly effective thermoset polymeric compositions for the pads 3 herein include a class of viscoelastic polyurethanes which contain a vegetable oil as the principle reaction media ingredient. In general, the precursor mixes for such applicable polyurethane thermosets typically include a plasticizing amount of polyol prepolymers reacted with a ring-opening species of a hardener (e.g. amines, amides, mercaptans, anhydrides, a polycyanates such as an isocyanates, etc.). Since the elastomeric features of the recoil absorbing pad 3 constitutes an essential attribute, the di- or polyol-reactants, hardeners, catalyst, reaction temperatures, etc. are collectively adapted to provide the desired viscoelastomeric and rebounding (recovery) properties for the recoil absorbing pad 3. Reactants, catalysts, reaction temperatures etc. which lead to an excessively rigid highly cross-linked thermoset polymeric structure fail to provide the necessary compression, rebound and tacky surface characteristics for pad 3 use herein. Reaction conditions and reactants which yield the more fluid, flexible and cushioning plasticized thermoset polymeric backbone structure in a colloidally dispersed form within the reaction media have been found to be particularly applicable for use as a pad 3 herein. Since the highly exothermic and elevated curing temperatures tend to be more conducive to the excessive cross-linkage and rigid thermoset; the proportion of the reactants, slow reaction rate catalysts, lower curing temperatures and relatively longer curing times are typically utilized to effectuate the desired degree of pad surface tack and recoil absorbing properties. These reaction conditions generally favor a creation of a more flexible, lower degree of cross-linkage as well as lower glass transition temperature for the manufacture of the most effective viscoelastomeric shock absorbing pads 3 herein.

U.S. Pat. No. 7,041,719 B2 to Matt Kriesel et. al. disclose polymerizable thermosetting reactants especially adapted to create a polyurethane thermoset polymerizate exhibiting exceptional viscoelastomeric pad properties herein. The resultant cured polyurethane thermoset reaction product provides unexpectedly superior recoil cushioning efficacy rendering the pads 3 manufactured therefrom especially suitable for use as the firearm recoil dampening shoulder pads 3 herein. These polyurethanes are typically formed by reacting a polyol with a di- or polyisocyanates such as the aromatic isocyanates (e.g. such as a diphenylmethane di-isocyanate-MDI or tolune di-isocyanate-TDI) and aliphatic isocyanates such as hexamethylene di-isocyanate (HDI) or isophorone di-isocyanate (IPDI) as the appropriate polyurethane isocyanate reactant. Particularly effective reactants for providing the recoil absorbing pad 3 herein are those obtained by reacting an isocyanate with certain prepolymers of polyoxy akylene diols prepolymers such as the polyoxyethylene and/or polyoxypropylene diols of a molecular weight ranging from about a 1000 to about 2000. The viscoelastomeric thermoset polymers prepared from such thermosetting reactants characteristically exhibit low rebound velocity and hysteresis properties. These viscoelastic thermoset polymers also exhibit exceptional energy and attenuating properties capable of withstanding prolonged repetitive shock stress without incurring any substantive viscoelastomeric structural damage, sag or rebound loss. These unique attributes coupled with excellent flexibility and tacky surface attributes render viscoelastomeric thermoset polymers exceptionally suitable for use as the firearm recoil absorbing pads 3 herein.

Another important attribute of the aforementioned viscoelastomeric thermoset polymeric reaction products resides in their unique surface tack properties. The surface tack provided the thermoset polymerizates herein serves to retain the firearm butt end against the pad 3 which allows for a more steadfast aim especially by retarding the recoiling bounce especially upon repetitive firearm shots. The cured thermoset viscoelastomeric mass as provided by these thermoset polymerizates accordingly provides excellent tack, flexibility, cushioning and rebounding characteristics especially adaptable for use as the shock absorbing pads 3 herein.

The viscoelastomeric thermoset polyurethane pads 3 herein may be prepared from slow curing and low viscosity thermosetting reactant conditions conducted under relatively low curing temperature conducive to enhanced polymeric flexibility. These viscoelastomeric thermosets possessing exceptional firearm shock arresting efficacy may be illustratively prepared by reacting a formulated thermosetting mix containing an epoxidized vegetable oil on weight basis as the major reaction media ingredient (i.e. typically more than about 50% of the total reactant mixture weight), a polyhydric prepolymer having a molecular weight of more than 1,000 (e.g. di- and tri-hydroxyl polyalkylene oxides) along with the hydrocarbon cyanates or isocyanates (e.g. aliphatic, aromatic, heterocyclic etc. polyisocyanates, cycloaliphatic, arylaliphatic) and an appropriate thermosetting catalyst. The curable precursor mix may then be cured in situ under thermosetting forming techniques to provide pad 3. Illustrative catalysts include the tertiary amines the tertiary phosphines, strong bases (e.g. alkali and alkaline earth metal hydroxides, alkoxides and phenoxides, and the acidic metal salts of strong acids, metal chelates, metal alcholates and phenolates, organic acid salts, organo metallic derivatives etc. (e.g. see column 4 line 35—column 5, line 32 of U.S. Pat. No. 7,041,719).

In general, the desired plasticity and flexibility attributes may be effectuated by interpolymerizing the higher molecular weight diols and polyols (e.g. molecular weight 2,000-10,000) with the other thermosetting reactants mentioned herein. The diols may be typically comprised of straight chain polyethylene oxide molecule having two terminal hydroxyl groups with the triols being a straight chain polyalkylene oxide having three hydroxyl groups (e.g. polyethylene or polypropylene triol). The di- and polyols of a relatively high molecular weight thus effectively serve as plasticizing polymeric reactants (especially the triols) adapted to reduce cross-linkage rigidity. The diols and triols effectively impart the desired flexibility compression and rebounding compatibility characteristics to the thermoset cured pad 3. On reactant weight percentage basis, the triols are generally less effective plasticizers than the diols. The diols accordingly typically require a lesser amount of reactant while also generally contributing to a more plasticized linkage within the thermoset polymeric structure.

The epoxidized vegetable oils have a major effect in providing the desired viscoelastomeric flexibility, plasticization and tack to the resultant cured thermoset polymeric pad 3. Particularly effective recoil absorbing, rebounding, surface tack and viscoelastic efficacy arise when the epoxidized vegetable oil weight reaction media content ranges between about 45 to about 70 parts by weight of the total reaction media weight. The epoxidized vegetable oil will most suitably comprise a major weight portion of the total reactant weight but typically less than about 70 and most typically less than 60 percent by weight of the total reaction media mixture weight. The molecular size and configuration, the polarity, the functional molecular groups etc. of the epoxidized vegetable oil collectively contribute towards achieving the desired recoil characteristics (e.g. viscoelastomeric, rebounding or recovery) and tack. Although the epoxidized vegetable oil may include a variety of epoxidized vegetable oils (e.g. castor, corn, cotton seed, *perilla*, safflower, linseed, soybean, tall, etc.), epoxidized soybean oil has been found to be especially effective for use as the epoxidized vegetable oil component in preparing shock absorbing pads 3 herein.

Imparting the desired flexibility, recoil cushioning and rebounding characteristics as well as the appropriate surface tack in the resultant viscoelastomeric thermoset polymerizate may be illustratively accomplished by utilizing a polyurethane precursor mix containing about 6 to about 12 percent by weight of a di-hydroxyl polyether polyol, (e.g.

ELASTOCAST C-4057 manufactured and distributed by BASF) about 20 to about 40 percent by weight of a tri-hydroxyl polyether polyol (e.g. ELASTOCAST C-4018 by BASF), about 5 to about 8 percent by weight of methylene diphenyl isocyanate based polyether prepolymer (e.g. ELASTOCAST TQZ-P23 by BASF Corporation), about 45 to about 70 percent by weight (preferably greater than 50 and less than 55 percent by weight) of an epoxidized soybean oil and from about 0 to about 10 percent by weight of a refined bleached soybean oil catalyized by a cocatalyst a combination of a dioctyltin (e.g. COTIN 430 supplied by Vertellus Specialties) and a Bismuth (3+) neodecanoate (e.g. COSCAT 83 supplied by Vertellus Specialties) at a combined catalytic concentration ranging from about 0.1 to about 0.6 percent by weight of the total reactant weight. Exemplary of other isocyanate reactants includes prepolymers of methylene diphenylisocynate reacted with polyoxyethlene or polyoxypropylene diols of a molecular weight ranging from 1000 and 2000 such as sold under the trademark of Isonate 21814 and Rubinate 1790®.

The expoxidized triglycerides of vegetable oil have been observed to uniquely contribute towards the desired prerequisite viscoelastic and recoil absorbing properties while also imparting the desired degree of surface tack efficacy. The particular catalyst, catalytic amounts, manner of application, amounts and proportion of the reactants, the type of reactants and the reaction conditions collectively have an effect upon the ultimate properties of the cured reaction product. Excessive cross-linkage leads to a rigid polymerizate lacking the necessary recoil absorbing attributes. Conversely insufficient cross-linkage likewise leads to a thermoset failing to possess a sufficient number of cross-linkages to create the desired viscoelastomeric characteristic of an effective shock absorbing polymerizate. The appropriate level of cross-linkage and molecular orientation coupled with the colloidal dispersion of the polymerizate within the vegetable oil dispersant of the reaction media provides the desired recoil absorption and rebound attributes along with the desired surface tack which yields a polymerizate having exceptional efficacy as the recoil absorbing pad 3 herein.

What is claimed is:

1. A firearm recoil absorbing assembly adapted for mounting to a shoulder region of a garment at a firearm aiming position, said assembly comprising:

a recoil absorbing pad comprising a thermoset polymerizate possessing sufficient viscoelastomeric characteristics to effectively cushion and rebound to an innate form from the recoiling forces of a firing firearm with the polymerizate having an outwardly exposed surface region juxtapositioned for interfacial adhesive contact to the butt end of the firearm while providing sufficient surface tack to adhesively engage and adhere onto a butt end of the firing firearm, a flexible pad retaining member serving as an open-faced retaining support for the recoil absorbing pad and a fastening member for fastening the assembly to the shoulder region.

2. The firearm recoil absorbing assembly according to claim 1 wherein the flexible pad retaining member comprises an open-faced vacuum molded thermoplastic film serving to retain the recoil absorbing pad with said film having a flanged lip for sewing the assembly to the shoulder region of the garment.

3. The firearm recoil absorbing assembly according to claim 1 wherein the polymerizate comprises a cured reaction product containing a vegetable oil as a major reaction media ingredient.

4. The firearm recoil absorbing assembly according to claim 3 wherein the polymerizate comprises a cured reaction product of a reactant media containing from 50 percent by weight to less than 60 percent by weight of an epoxided vegetable oil, about 6 to about 12 percent to weight of a polyether having two functional hydroxyl groups, about 25 to about 35 percent by weight of a polyol having three functional hydroxyl groups, about 5 to about 8 percent by weight of an isocyanate based polyether prepolymer, and from about 0 to about 10 percent is weight of a vegetable oil.

5. The firearm recoil absorbing assembly according to claim 1 wherein the recoil absorbing pad includes a removable protective cover for temporarily shielding the exposed surface region of the polymerizate from external contaminates.

6. The firearm recoil absorbing assembly according to claim 2 wherein the firearm recoil absorbing assembly includes multiple recoil absorbing pads including an outer recoil absorbing pad having the outwardly exposed surface region of the polymerizate exposed for the interfacial abutment onto the butt end of the firing firearm.

7. The firearm recoil absorbing assembly according to claim 3 wherein the attaching member includes a fastening member comprising paired fastening members for attachment and detachment of the firearm recoil absorbing assembly from the mounting site wherein at least one of the paired fasteners is attached to the flexible retaining member and another of the paired fasteners being adapted for attachment to the mounting site.

8. The firearm recoil absorbing assembly according to claim 7 wherein the paired fasteners comprise a combination of male and female fasteners.

9. The firearm recoil absorbing assembly according to claim 8 wherein the paired fasteners comprise a female napped loop fastener and a male napped hook engaging fastener.

10. A firearm recoil arresting combination mounted to a shoulder region of a garment at a firearm aiming position, said combination comprising:

a firearm recoil arresting assembly equipped with:

a recoil absorbing pad comprised of a thermoset viscoelastomeric polymerizate possessing sufficient viscoelastomeric characteristics to absorb and rebound from recoiling forces of a firing firearm and an outer exposed surface area of sufficient surface adhesiveness to create an adhesive adherence to a butt end of the firing firearm;

a flexible retaining member serving to positionally retain the exposed surface area of the polymerizate in a substantially open position for interfacial contact to the butt end of the firearm; and a fastening member for fastening the firearm recoil absorbing assembly to the shoulder region; and an upper torso garment having the firearm recoil arresting assembly mounted at the shoulder region of the garment.

11. The combination according to claim 10 wherein the flexible retaining member of the firearm recoil arresting assembly comprises an open-faced vacuum molded flexible thermoplastic film which matingly engages onto the polymerizate and serves to adhesively retain the firearm recoil absorbing pad to the molded flexible thermoset film.

12. The firearm recoil arresting combination according to claim 11 wherein the flexible retaining member comprises an open-faced molded thermoplastic film having a flanged lip for sewing the assembly to the mounting site of the garment with the firearm recoil arresting assembly being sewn thereto.

13. The firearm recoil arresting combination according to claim 10 wherein the polymerizate comprises a cured reaction product of a reactant media containing from 50 percent by weight to less than 60 percent by weight of an epoxidized vegetable oil, about 6 to about 12 percent by weight of a polyether polyol having two functional hydroxyl groups, about 25 to about 35 percent by weight of a polyether having three functional hydroxyl groups, about 5 to about 8 percent by weight of an isocyanate based polyether prepolymer and from about 0 to about 10 percent by weight of a bleached vegetable oil.

14. The firearm recoil arresting combination according to claim 10 wherein the exposed surface area of the polymerizate includes a removable protective cover for temporarily shielding the polymerizate from external contaminates when the firearm recoil arresting combination is not being used to absorb the recoiling forces of the firing firearm.

15. The firearm recoil arresting combination according to claim 10 wherein the firearm recoil arresting assembly includes multiple recoil absorbing pads of the polymerizate.

16. The firearm recoil arresting combination according to claim 13 wherein the fastening member includes paired coupling fasteners for attachment and detachment of the firearm recoil arresting assembly to the garment with said paired coupling fasteners being fastened together at the garment at the firearm aiming position.

17. The firearm recoil arresting combination according to claim 16 wherein the fastening member comprises paired male and female fasteners fastened together with one of said paired fasteners being affixed to the flexible retaining member and another of said paired fasteners being affixed to the shoulder region.

18. The firearm recoil arresting combination according to claim 17 wherein the paired fasteners comprise a female napped loop fastener and male hook engaging fastener.

19. The firearm recoil arresting combination according to claim 15 wherein the polymerizate of an inner pad of the multiple pads serves to adhesively engage and mount the flexible retaining member to the shoulder region of the garment.

20. A method for arresting a recoiling effect of a firing firearm, said method comprising:

providing a firearm recoil arresting assembly comprised of:

a recoil absorbing pad equipped with an open-faced adhesive and cohesive thermoset viscoelastomeric polymerizate possessing sufficient viscoelastomeric characteristics to absorb recoiling forces of a firing firearm with said polymerizate having an outwardly exposed surface area of sufficient surface tack to engage and and adhere to a juxtapositioned butt end of the firing firearm a flexible retaining member serving to retain the recoil absorbing pad with said flexible retaining member having a substantially open outer surface region to permit interfacial contact of the polymerizate with the butt end of the firing firearm an attaching member for attaching the firearm recoil arresting assembly to the shoulder region at a firearm mounting site for the shooting firearm; and mounting the firearm recoil arresting assembly with said attaching member to the mounting site, placing the butt end to the firearm mounting site at an aiming position and shooting the firearm so as to thereby arrest with said firearm recoil arresting assembly the recoiling effect created by the firing firearm.

* * * * *